US006273303B1

(12) United States Patent
de Pous et al.

(10) Patent No.: US 6,273,303 B1
(45) Date of Patent: Aug. 14, 2001

(54) FIXING MEMBER FOR FIXING A DISPENSER DEVICE TO THE NECK OF A CONTAINER, A DISPENSER USING SUCH A FIXING MEMBER, AND A METHOD OF PERFORMING SUCH FIXING

(75) Inventors: Olivier de Pous, Paris; Christian Campfort, Cléon, both of (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/421,459

(22) Filed: Oct. 19, 1999

(30) Foreign Application Priority Data

Oct. 20, 1998 (FR) ..... 98 13107

(51) Int. Cl.[7] ..... B65D 47/00
(52) U.S. Cl. ..... 222/402.1; 222/1; 222/321.7
(58) Field of Search ..... 222/1, 321.7–321.9, 222/402.1; 215/274, 275, 277, 292; 220/915

(56) References Cited

U.S. PATENT DOCUMENTS

| | | | | |
|---|---|---|---|---|
| 2,645,386 | * | 7/1953 | Bobrick | 222/321.9 |
| 5,183,188 | | 2/1993 | Rebeyrolle et al. | 222/321.9 |
| 5,299,703 | | 4/1994 | Cater | 215/274 |
| 5,348,174 | | 9/1994 | Velicka | 215/277 |

FOREIGN PATENT DOCUMENTS 0 806 248 A1 11/1997 (EP) .

* cited by examiner

*Primary Examiner*—J. Casimer Jacyna
(74) *Attorney, Agent, or Firm*—Rockey, Milnamow & Katz, Ltd.

(57) ABSTRACT

A fixing member for fixing a dispenser device to the neck of a container, said fixing member comprising a ring made of a plastics material and provided with fixing means for fixing to the neck of the container, and a metal dished washer received in the ring and provided with holding means for holding the dispenser device.

13 Claims, 3 Drawing Sheets

FIXING MEMBER FOR FIXING A DISPENSER DEVICE TO THE NECK OF A CONTAINER, A DISPENSER USING SUCH A FIXING MEMBER, AND A METHOD OF PERFORMING SUCH FIXING

The present invention relates to a fixing member for fixing a dispenser device such as a pump or a valve to the neck of a container. For example, in order to fix the body of a pump to the neck of a flask, it is necessary to use a coupling piece which may be in the form of a ring or of a fixing turret, or else in the form of a crimped capsule. A snap-fastenable or screw-on ring or turret, and a crimpable capsule constitute the two techniques that are in most widespread use in the perfumery and cosmetics industry.

BACKGROUND OF THE INVENTION

Accompanying FIG. 2 shows a dispenser device 4 equipped with a fixing member in the form of a plastics ring to be snap-fastened onto the neck of a container. Accompanying FIG. 1 shows the fixing ring only. In general, such a dispenser device, which may be a pump or a valve, is constituted by a body 41 defining an outwardly-projecting rim 42 at its top end. An actuating rod 43 projects upwards beyond the rim 42. A pushbutton 4 provided with a nozzle 45 is mounted on the actuating rod 43. Conventionally, the dispenser device is actuated by pushing the pushbutton 4 so that the actuating rod 43 penetrates into the body 41. Such a dispenser device design is quite conventional and is in no way critical for the present invention.

To fix such a dispenser device to the neck of a container (not shown), the fixing ring 1 that is used comprises fixing means for fixing to the neck of the receptacle, and body-receiving means for receiving the body 41 of the dispenser device 4. In that prior art ring 1, the fixing means are in the form of snap-fastening catches 12 whose bottom ends are provided with inwardly-projecting snap-fastening heads 13. The snap-fastening catches 12 are flexible enough to enable the snap-fastening heads 13 to pass over the neck of the container and to snap-fasten below said neck. As shown in FIG. 2, the ring 1 is fixed permanently onto the neck by means of a locking band 3 which covers the fixing ring 1 so that the snap-fastening heads 13 cannot move radially outwards. Permanent fixing is thus achieved. The means provided on the fixing ring 1 for the purpose of receiving the body 41 of the dispenser device 4 are in the form of a snap-fastening recess 17, in which the rim 42 of the body 41 is engaged by force. The snap-fastening recess 17 is formed by a cylindrical wall 16 whose bottom end is connected to the snap-fastening catches 12 via an annular flange 11, and whose top end is extended by another annular flange 18 provided with a through hole 19 in its center for passing the actuating rod 43. To enable the rim 42 to be received by snap-fastening in the recess 17, the inside of cylindrical wall 16 is provided with snap-fastening bulges which locally narrow the entrance to the snap-fastening recess 17. Such a fixing ring design is quite conventional.

Recently, attempts have been made to reduce the height between the top end of the pushbutton 4 and the annular coupling flange 11 of the fixing ring 1, for reasons of esthetic appearance. The inside surface of the coupling flange 11 constitutes the abutment surface against which the sealing gasket that is placed on the neck of the receptacle is disposed. As a result, the height between the pushbutton 4 and the flange 11 constitutes the height over which the dispenser device projects beyond the neck of the receptacle.

In fields such as those of perfumery and of cosmetics, in which the esthetic appearance of the dispenser is particularly important, it is naturally preferred for that height to be as small as possible so as to leave very little of the dispenser device visible on the container. For any given dispenser device, the pushbutton-to-flange height is determined directly by the height of the cylindrical wall 16 connecting the flange 11 to the flange 18, as shown in FIG. 1.

Therefore, the technical problem for the present invention is to make it possible to reduce the distance between the two flanges 11 and 18. This is not possible with a prior art fixing ring as shown in FIGS. 1 and 2. In order for the snap-fastening recess 17 to be resilient enough to enable the cylindrical wall 16 to deform radially outwards when the rim 42 passes between the snap-fastening bulges 15, it is absolutely essential for the cylindrical wall 16 to be tall enough. It is therefore not possible to reduce the height, because, at the coupling flange 11 and at the top flange 18, the wall 16 has no resilience. This requirement that the cylindrical wall 16 must be resilient is also necessary for removing the fixing ring 1 from its mold when the pin that has served to mold the recess 17 is to be extracted. If the wall 16 tis not resilient enough, it is not possible to extract the pin from the recess without damaging the coupling flange 11. For both of these reasons related firstly to unmolding, and secondly to snap-fastening the rim 42 of the body 41 of the dispenser device, it is not technically possible to reduce the height of the cylindrical wall 16 of a prior art fixing ring as shown in FIGS. 1 and 2.

OBJECTS AND SUMMARY OF THE INVENTION

An object of the present invention is thus to mitigate that drawback of the prior art by defining a fixing member in which the distance between the coupling flange and the end flange is as short as possible.

The invention achieves this object by means of a fixing member for fixing a dispenser device to the neck of a container, said fixing member comprising a ring made of a plastics material and provided with fixing means for fixing to the neck of the container, and a metal dished washer received in the ring and provided with holding means for holding the dispenser device. The combined use of a plastics ring and of a metal dished washer offers the combined advantages of a ring that is made of plastic (i.e. that is easy to fix by snap-fastening or screw engagement) and of a dished washer that is made of metal (i.e. that enables the fixing device to be held by crimping). The use of a plastics ring makes it possible to accommodate several simple and quick fixing modes that require no special tool, and makes it easy to clad the ring with an outer band of attractive appearance. Crimping the fixing device by means of a metal dished washer takes up only a very small amount of height since the problems of resilience related to the cylindrical wall of the prior art ring no longer exist. The dished washer is deformed only once the fixing device is already in place ready for crimping. It is thus possible to deform the dished washer over a height that is very small compared with the height of the cylindrical wall of the prior art fixing ring. Therefore, the operation of mounting the fixing member on the dispenser device begins with the dished washer being mounted onto the rim of the dispenser device. Naturally, this operation is preferably performed by crimping, although other fixing methods are not excluded. Then, the dished washer as equipped with its dispenser device is engaged in the plastics ring in which it may advantageously be received by snap-fastening. The dispenser device as equipped with its fixing member is then ready to be mounted on the neck of a container by using a sealing gasket interposed between the dished washer and the neck of the container. Depending on the fixing mode used, the ring is either screwed on or else it is snap-fastened to the neck of the container, and it is then locked by a band.

The dispenser device as equipped with its dished washer thus constitutes a sub-assembly that is engaged in a plastics ring which, depending on the fixing mode chosen, is provided with snap-fastening means or with screw-engagement means. The dished washer thus constitutes a standard element for any given dispenser device, whereas the plastics ring provides a certain amount of modularity concerning the technique used to fix it to the neck. It should also be noted that such a plastics ring is extremely simple to mold since it is almost entirely cylindrical.

BRIEF DESCRIPTION OF THE DRAWINGS

The invention is described in more detail below with reference to the accompanying drawings which show an embodiment of the invention by way of non-limiting example, and in which.

MORE DETAILED DESCRIPTION

Figure 1:
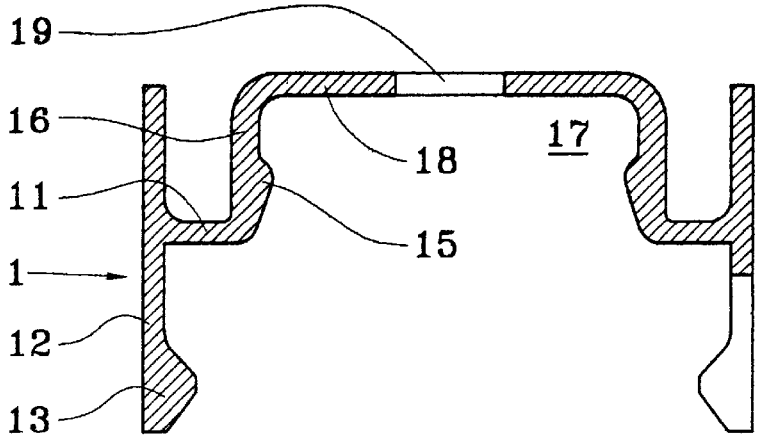
FIG. 1 PRIOR ART
FIG. 1 is a view in section through a prior art fixing ring.
Figure 2:
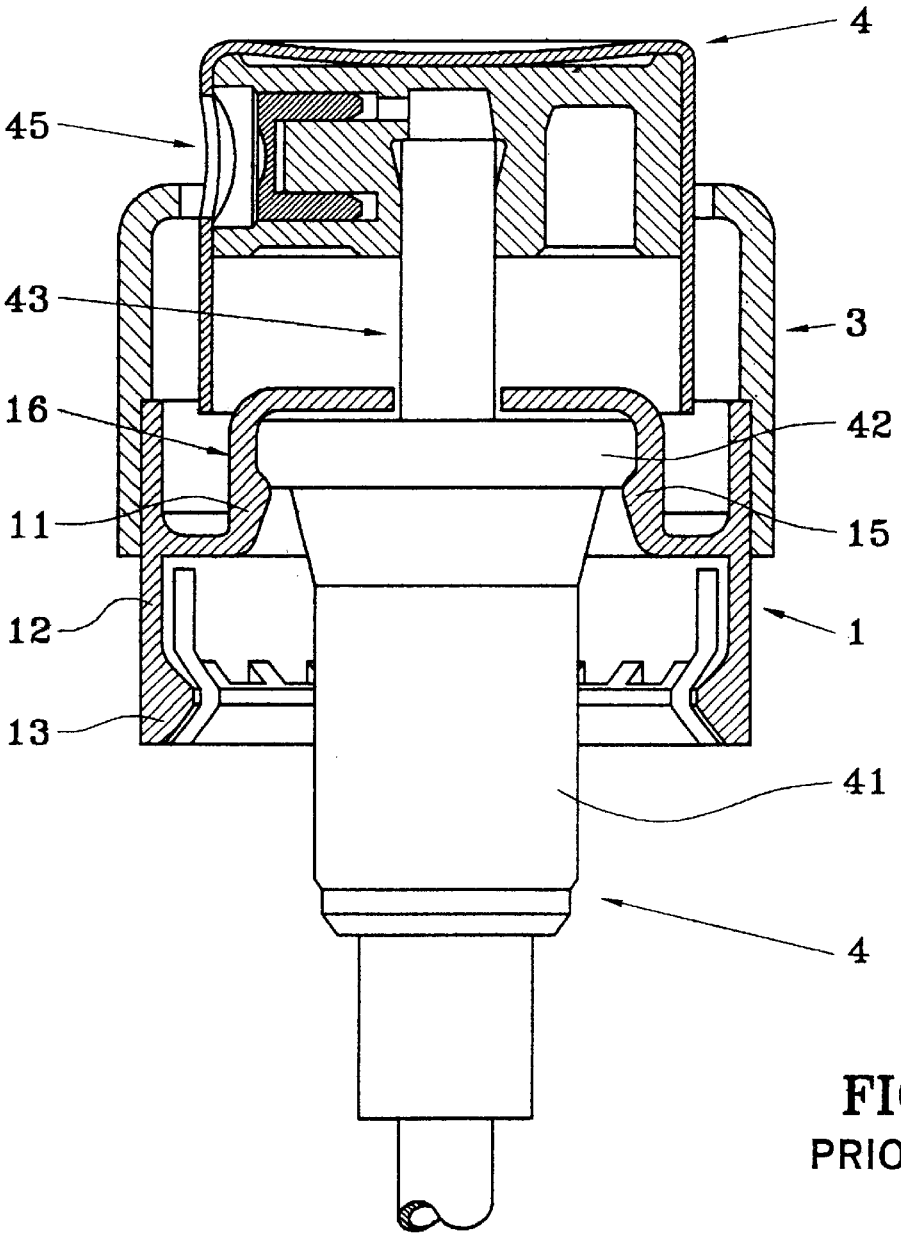
FIG. 2 PRIOR ART
FIG. 2 is a view in section through a dispenser device equipped with the fixing ring shown in FIG. 1.
Figure 3:
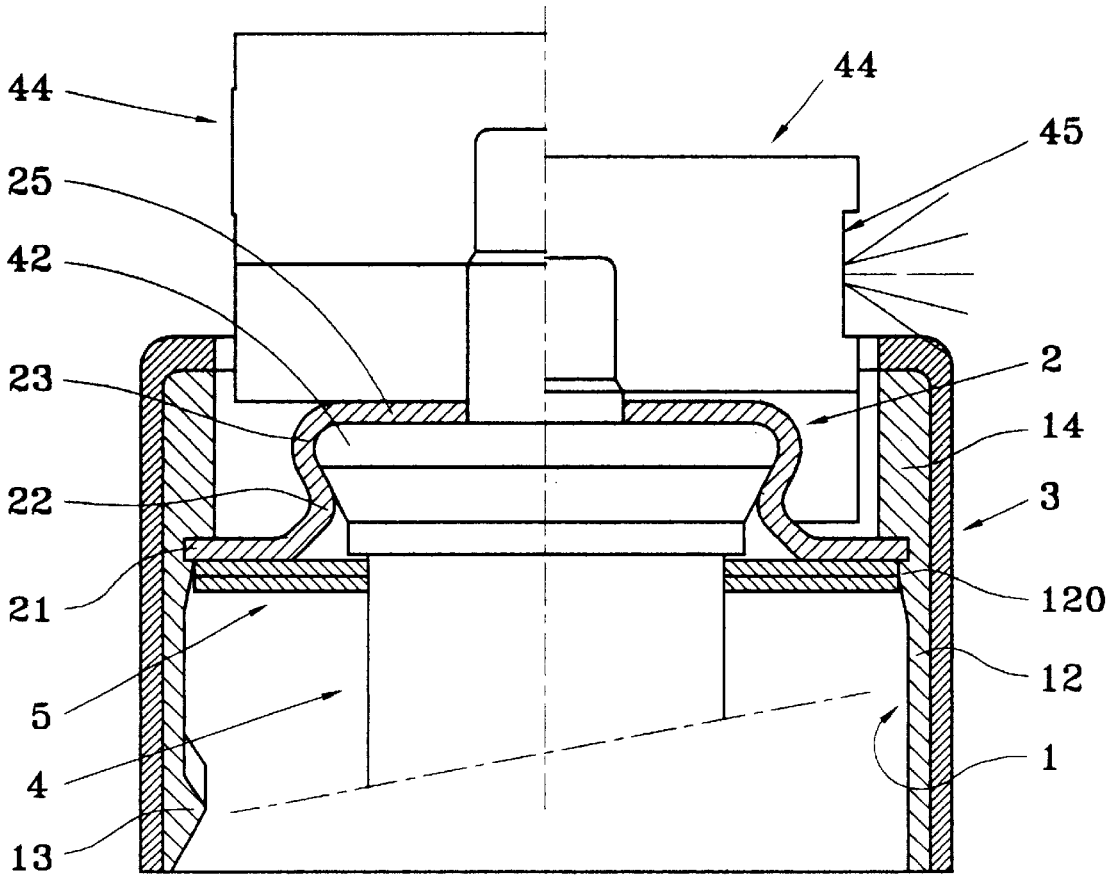
FIG. 3 is a view in section through a dispenser device equipped with a fixing ring of the present invention, the left half of the figure showing the dispenser device in its rest position, and the right half showing the dispenser device while it is being actuated.
Figure 4:
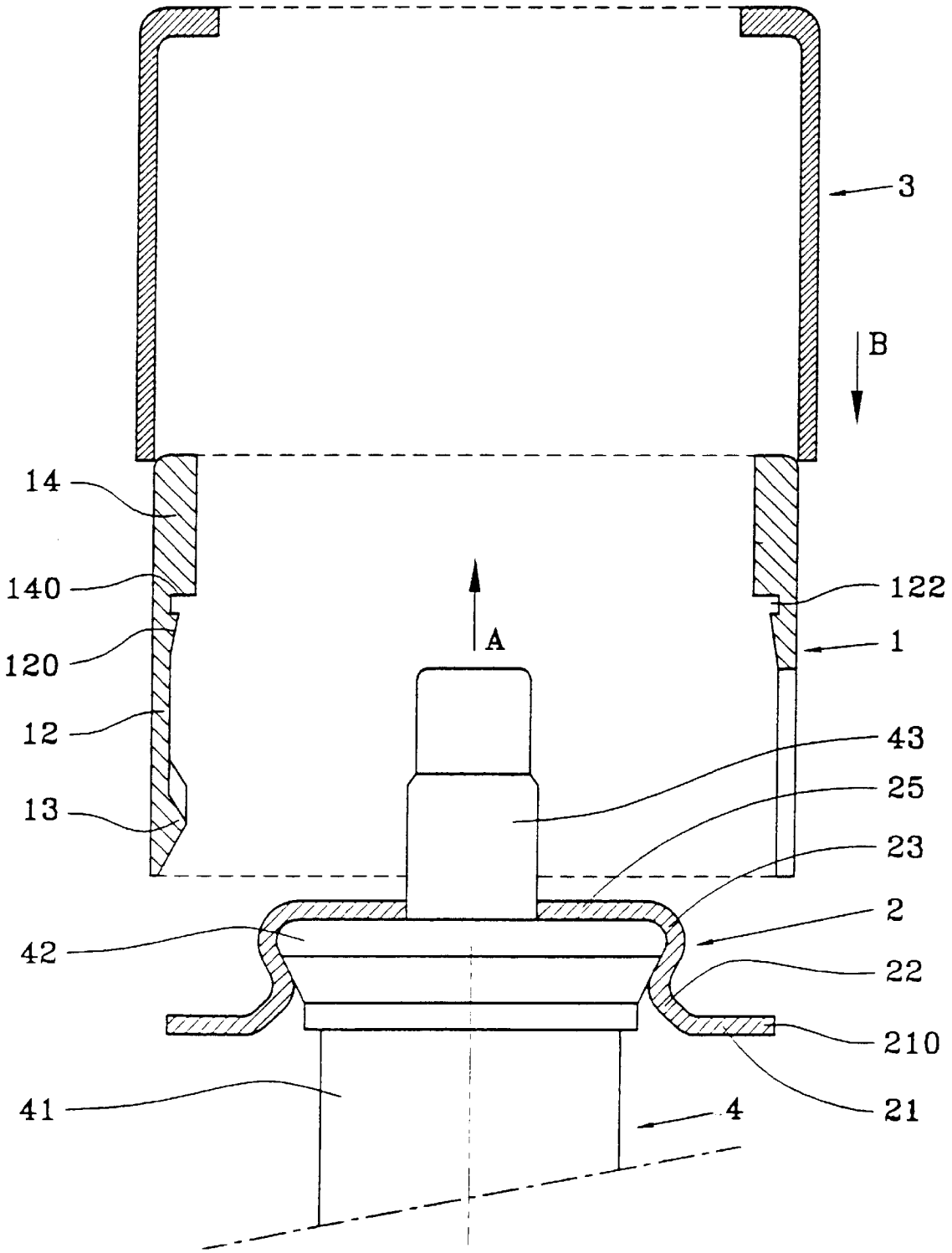
FIG. 4 is an exploded view of the dispenser device of FIG. 3, showing the method of mounting such a fixing member on a dispenser device.

The fixing member used to illustrate the present invention and shown in FIGS. 3 and 4 comprises two essential component parts, namely a ring 1 made of a plastics material, and a dished washer 2 made of metal. In the fixing mode described herein, the ring is fixed permanently to the neck of the tank by means of a band 3 which is in the form of a cylinder terminated at its top end by an inwardly-extending annular rim. The implementation of such a band 3 does not constitute an essential element of the present invention because it depends on the way the ring is fixed to the neck of the tank. In certain types of snap-fastening, such a band is not necessary. Similarly, when the ring is screwed onto the neck, the use of such a band becomes entirely superfluous. Therefore, the fixing member of the present invention is essentially made up of the plastics ring 1 and of the metal dished washer 2.

The plastics ring 1 is in the form of a substantially cylindrical piece. The bottom of the ring forms snap-fastening catches 12 which are terminated by snap-fastening heads 13 that are in the form of lugs that project inwardly. The catches 12 thus extend downwards individually so that they are radially resilient. The top of the plastics ring 1 forms a sleeve 14 which serves to mask the dished washer 2 as well as the actuating rod 43 of the dispenser device so that, at rest, the bottom end of the pushbutton does not project from the sleeve 14, for reasons of esthetic appearance. The sleeve 14 may also serve to form guide walls for the pushbutton 44. Above the snap-fastening catches 12 and below the sleeve 14, the plastics ring 1 forms a snap-fastening recess 122 defined between a bottom annular wall 140 of the sleeve 14 and snap-fastening teeth 120. The annular recess 122 serves to receive the metal dished washer 2.

The metal dished washer 2 is formed with a coupling flange 21 whose peripheral end 210 is suitable for being received by snap-fastening in the snap-fastening recess 122 formed by the plastics ring 1. When the metal dished washer 2 is mounted on the dispenser device 4, in particular at the projecting rim formed by the body 41 of the dispenser device, the metal dished washer forms a waist 22 below the rim 4, which waist flares outwards to form a bulge 23 extended by a top flange 25 in which the hole is provided through which the actuating rod 43 of the dispenser device 4 passes. The waist 22, the bulge 23, and the top flange 25 form a recess in which the rim 42 is held securely. Preferably, the rim is received 42 by crimping. In which case, the metal dished washer 2 is not initially provided with a waist 22 which is formed by crimping only after the dispenser device has been put in place. The resulting sub-assembly comprising the metal dished washer 2 and the dispenser device 4 is then engaged in the plastics ring 1 in the direction indicated by arrow A in FIG. 4 until the peripheral edge 210 of the coupling flange 21 snap-fastens inside the recess 122 provided in the ring 1. The resulting assembly is then ready to be snap-fastened to the neck of a container with a gasket being interposed between the coupling flange 12 and the neck of the container. Finally, in the present embodiment, the band 3 is engaged over the plastics ring 1 in the direction indicated by arrow B so that said band covers said ring and prevents the snap-fastening catches from being released below the neck of the container.

This combined plastics-and-metal fixing member combines the advantages of plastic related to its moldability and its resilience, and the advantages of metal related to its ductility (for crimping).

What is claimed is:

1. A fixing member for fixing a dispenser device to the neck of a container wherein said dispenser device has a body and an actuating rod reciprocatable thereon, said fixing member comprising a ring made of a plastic material and provided with fixing means for fixing to the neck of the container, and a metal dished washer received in the ring and provided with holding mean for holding said body of the dispenser device.

2. A fixing member according to claim 1, in which the ring is provided with snap-fastening washer-receiving means for receiving the dished washer.

3. A fixing member according to claim 1, in which the holding means of the dished washer are means for holding the dispenser device by crimping.

4. A fixing member according to claim 1, in which the fixing means for fixing the ring to the neck of the container are snap-fastening fixing means or screw fixing means.

5. A fixing member according to claim 1, further including one of a pump and a valve, and further including a container provided with a neck, said dispenser device being mounted on said neck.

6. A method of mounting a dispenser device on a neck of a container wherein said dispenser device has a body and an actuating rod reciprocatable thereon, said method comprising the following steps:

mounting a metal dished washer on the dispenser device;

engaging said washer together with said body of said dispenser device in a ring made of a plastics material; and fixing the ring to the neck of the container.

7. A method according to claim 6, in which the step of mounting the dished washer on the dispenser device is performed by crimping.

8. A method according to claim 6, in which the step in which the dished washer is engaged is performed by snap-fastening.

9. A method according to claim 6, in which the fixing step in which the ring is fixed is performed by snap-fastening or screw engagement.

10. A fixing member for fixing a dispenser device to the neck of a container, said fixing member comprising a ring made of a plastics material and provided with fixing means for fixing to the neck of the container, and a metal dished washer received in the ring and provided with holding means for holding the dispenser device, said ring being provided with snap-fastening washer-receiving means for receiving the dished washer.

11. A fixing member for fixing a dispenser device to the neck of a container, said fixing member comprising a ring made of a plastics material and provided with fixing means for fixing to the neck of the container, and a metal dished washer received in the ring and provided with holding means for holding the dispenser device, said holding means of the dished washer being means for holding the dispenser device by crimping.

12. A method of mounting a dispenser device on a neck of a container, said method comprising the following steps:

mounting a metal dished washer on the dispenser device by crimping said metal dished washer to said dispenser device;

engaging said washer together with its dispenser device in a ring made of a plastics material; and fixing the ring to the neck of the container.

13. A method of mounting a dispenser device on a neck of a container, said method comprising the following steps:

mounting a metal dished washer on the dispenser device by snap-fastening said metal dished washer on said dispenser device;

engaging said washed together with its dispenser device in a ring made of a plastics material; and fixing the ring to the neck of the container.

* * * * *